US006419135B1

(12) United States Patent
Sali

(10) Patent No.: US 6,419,135 B1
(45) Date of Patent: Jul. 16, 2002

(54) LIMITED STRETCH CORD FOR A FRUIT PICKING RECEPTACLE

(76) Inventor: Kasper B. Sali, 2003 Birchfield Rd., Yakima, WA (US) 98901

( * ) Notice: Subject to any disclaimer, the term of this patent is extended or adjusted under 35 U.S.C. 154(b) by 0 days.

(21) Appl. No.: 09/827,628

(22) Filed: Apr. 6, 2001

(51) Int. Cl.[7] ..... A45F 3/02

(52) U.S. Cl. ..... 224/610; 24/300; 57/210; 383/2; 383/67

(58) Field of Search ..... 383/2, 67; 224/610, 224/611; 24/300; 57/210

(56) References Cited

U.S. PATENT DOCUMENTS

| | | | | | |
|---|---|---|---|---|---|
| 517,786 | A | | 4/1894 | Woodward | |
| 719,810 | A | | 2/1903 | Jones | |
| 760,048 | A | | 5/1904 | Wilson | |
| 978,429 | A | | 12/1910 | Barnett | |
| 1,097,374 | A | | 5/1914 | Summers | |
| 1,645,360 | A | | 10/1927 | Taylor | |
| 1,754,100 | A | * | 4/1930 | Hammock et al. | 383/67 |
| 1,992,369 | A | | 1/1935 | Grabill | |
| 1,994,362 | A | | 2/1935 | Kavanagh | 150/2 |
| 1,992,849 | A | | 8/1935 | Walter | 150/2 |
| 3,746,066 | A | | 7/1973 | McIntyre | 150/33 |
| 4,102,376 | A | | 7/1978 | Sharp | 150/2 |
| 4,540,173 | A | * | 9/1985 | Hopkins, Jr. | 272/139 |
| 4,694,541 | A | * | 9/1987 | Skyba | 24/301 |
| 4,777,784 | A | * | 10/1988 | Ferguson | 54/34 |
| 4,925,071 | A | | 5/1990 | Fleming et al. | 224/207 |
| 5,201,446 | A | | 4/1993 | Martin | 224/205 |
| 5,505,161 | A | * | 4/1996 | Swendseid | 119/708 |
| D387,555 | S | | 12/1997 | Miller | D3/244 |
| 5,720,700 | A | * | 2/1998 | Buoni et al. | 482/124 |
| 5,741,207 | A | * | 4/1998 | Buoni et al. | 482/124 |

FOREIGN PATENT DOCUMENTS

| | | | |
|---|---|---|---|
| WO | WO 97/14292 | 4/1997 | A01D/42/22 |

* cited by examiner

*Primary Examiner*—Stephen P. Garbe
(74) *Attorney, Agent, or Firm*—Stratton Ballew PLLC

(57) ABSTRACT

A bottom support cord having a limited stretch for use with a conventional produce harvesting receptacle, such as a fruit picking bucket or bag often used in the harvesting of tree fruit, such as apples, pears, and peaches. The bag is typically tubular with a top opening and a bottom opening. A pair of stretchable support cords replace the typical support ropes that permanently attach to the bag at the bottom and removably attached near the top at a pair of cord receivers. The support cords have a tubular outer sheath that stretches. Within the outer sheath, a non-stretchable inner cord limits the outer sheath's extension. The bag folds upwardly, near the bottom to retain a quantity of produce within. When both support ropes are removed from the cord receivers, the bottom of the bag folds down to dump the produce. The stretchable support cords extend to increase the holding capacity of the bag automatically. To prevent bruising produce initially placed into the bag, the produce does not drop to the bottom of the fully extended bag, but instead only to the bottom of the retracted bag. The stretched support cords allow the bag to extend to limits in response to the weight of the fruit in the bag, as constrained by the inner cord.

5 Claims, 5 Drawing Sheets

LIMITED STRETCH CORD FOR A FRUIT PICKING RECEPTACLE

TECHNICAL FIELD

The invention relates to a limited stretch cord for a fruit picking bucket, basket, bag or similar produce harvesting receptacle, and more particularly to a support cord having a limited elastic range for use in retaining the bottom opening of such a produce picking receptacle.

BACKGROUND OF THE INVENTION

The conventional produce harvesting receptacle, commonly called a fruit picker's bucket or bag, which is a substantially tubular bucket or bag with a top opening and a bottom opening. Typically, a pair of supportive ropes, cords, chains or wires are permanently attached to the tubular bag at the bottom opening. These two ropes removably attach to the tubular bag proximate to the top opening to close off the bottom opening.

Examples of fruit picking receptacles include U.S. Pat. Nos. 517,786; 719,810; 760,048; 1,097,374; 1,994,362; and 4,925,071. A common problem with these prior fruit picking bags and buckets is that they fail to solve the problem of volume versus drop distance. Specifically, when the fruit is first placed into the bucket or bag, the fruit must be let go by the picker and so the fruit falls to the bottom of the bag. Subsequent fruit impacts upon the first fruit placed into the bag and bruising occurs. If the bag or bucket is reduced in size, then the picker must remove the contents of the bag or "dump" it at more frequent intervals, which takes time away from picking. Adjustable bag systems, with incremental size adjustments to the receptacle made possible by knots or slots in the adjustment straps is taught by the early U.S. Pat. No. 719,810 to Jones. However, adjusting the size of the picking bag, especially when it is partially filled with fruit, takes time and can result in the unwanted release of fruit from the bottom of the bag.

A produce picking receptacle is needed that somehow increases in volume as more fruit is received into it. Thereby reducing damage and bruising to the fruit, and making it unnecessary for the picker to make such needed adjustments manually.

SUMMARY OF INVENTION

The present invention provides an improvement in the bottom support cords utilized with a conventional produce harvesting receptacle, such as a fruit picking bucket or bag.

These conventional receptacles are often used in the harvesting of tree fruit, such as apples, pears, and peaches. For the purposes of the present invention, the produce harvesting receptacle is typically configured with a substantially tubular bag. The bag has a top opening and a bottom opening. A first support rope and a second support rope are permanently attached to the tubular bag at the bottom opening and removably attachable to the tubular bag proximate to the top opening. The first support rope attaches near the top opening at a first cord receiver and the second support rope attaches near the top opening at a second top cord receiver. The tubular bag is upwardly "foldable," proximate to the bottom opening. This fold helps retain a quantity of a produce product within the tubular bag. With the first support rope is received into the first top cord receiver and the second support rope received into the second top cord receiver, the tubular bag is kept folded. With both the first support rope removed from the first top cord receiver and the second support rope removed from the second top cord receiver, the bottom opening of the tubular bag is downwardly "unfoldable" to dump the produce product from the bottom opening.

The improvement provided by the present invention is in the unique construction and functional properties of a support cord that extends to increase the holding capacity of the produce picking receptacle automatically. Produce, which is typically a tree fruit, that is initially placed into the tubular bag does not drop to the deep bottom of the fully extended bag, but instead only to the bottom of the retracted bag, thereby preventing bruising of the fruit.

The improved stretch cord of the present invention allows the bag to extend with the weight of the fruit as it is placed into the bag. The stretch cord has a tubular outer sheath that can stretch to approximately double its length. Interior to the tube, a non-stretchable cord is also included. The non-stretchable cord limits the stretching of the outer tube to a specific and preset length, to prevent fruit from spilling out of the bottom of the bag, and also to prevent over-stretching or breaking of the outer tube. Both ends of the limited stretch cord are knotted to lock in the inner "stop" chord, and to attach the stretch cord to a bottom eyelet and to removably catch into a top hook of the bag.

Specifically, the first support cord and the second support cord stretch to extend the length of the tubular bag in response to the quantity of the produce product received into the produce picking receptacle. The first support cord and the second support cord have a limited stretch or extension. This limited extension prevents the produce product from escaping out of the bottom opening of the tubular bag when the first support cord is received within the first top cord receiver and the second support cord is received within the second top cord receiver.

The first support cord and the second support cord both have an inner stop cord within an outer sheath. The inner stop cord has a fixed length, and is substantially inelastic. The outer sheath has a hollow core and is substantially elastic and tubular. The outer sheath is stretchable from a relaxed length to a stretched length. The inner cord is received within the hollow core of the outer sheath. The fixed length of the inner stop cord is approximately equal to the partially stretched length of the outer sheath. The limited stretch cord extends the length of the receptacle as a quantity of fruit is placed into the receptacle.

The invention will be better understood by reference to the following detailed description taken in conjunction with the accompanying drawings.

DETAILED DESCRIPTION OF SPECIFIC EMBODIMENTS

Figure 1:
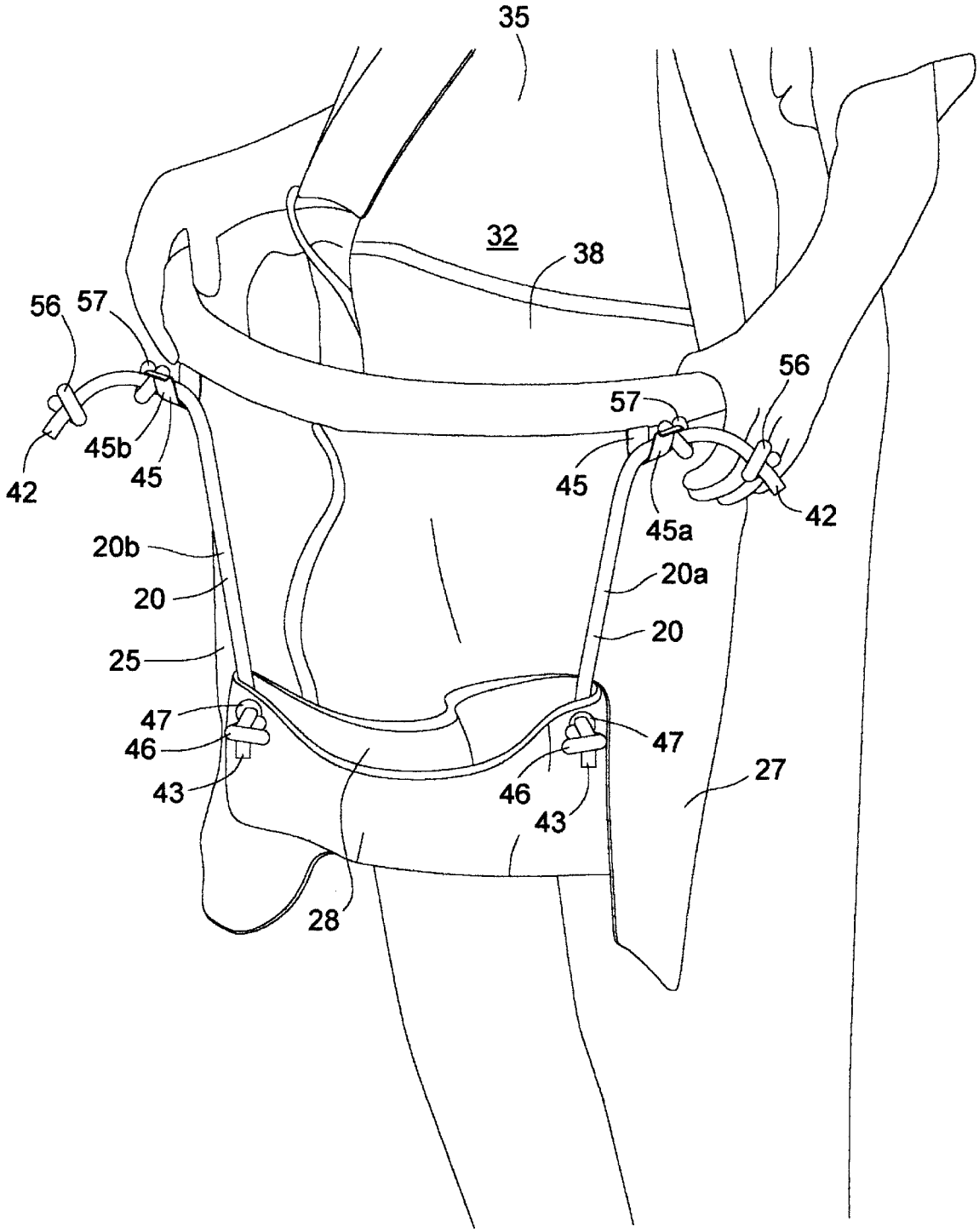
FIG. 1 is a perspective view of a support cord for a produce picking receptacle, as attached to the produce picking receptacle, according to an embodiment of the invention.

The invention provides a support cord for a produce picking receptacle, and more particularly an improved support cord having a limited stretch. The support cord automatically extends in response to the weight of the produce or fruit received into the receptacle.

The support cord 20 of the present invention is shown in FIGS. 1 through 11. As detailed in FIGS. 1 and 2, a pair of the support cords, specifically a first support cord 20*a* and a second support cord 20*b* are utilized in the same position as support ropes in a conventional produce picking receptacle 25. The support ropes are preferably utilized in pairs, in place of the conventional ropes. However, a single cord could be adapted for the purposes of the present invention, as will be discussed further herein.

The conventional produce picking receptacle 25 is also referred to in the industry and herein as a "picking bucket" or "picking bag." The picking bag is employed for a wide variety of manual harvesting operations, which can include the picking of fresh produce such as tree and vine fruits, but also can include vegetables and any other harvested commodity. The only broad requirement for such a commodity, for use with the present invention, is that the commodity be generally suited for collection with the picking bag. These conventional picking bags are most often used in the harvesting of tree fruits, such as apples, pears, and peaches.

The conventional produce picking receptacle 25 is essentially a tubular bag 27 or bucket, with a bottom opening 28 that is configured to be closable. This conventional picking bag is typically fabricated from a heavy canvas-like material, such as a "cordura" type of nylon fabric. Alternatively, the picking bag can be fabricated from any woven or non-woven fabric, which can additionally be coated with a water resistant material such as wax, rubber, or a plastic material, such as latex or "nitrile." In certain instances, the picking bag may be left uncoated. Traditionally, bags of this type are made from a cotton canvas. Vinyl, nylon, polyethylene, polyester or a combination of any of these materials might also be employed. Additionally, metal plates or bucket shaped inserts can also be included in the construction of the picker's bag. Other alternative embodiments of the conventional picking bag or bucket, as may vary from these known alternatives, would likely also benefit from the improvements offered with the present invention.

Figure 2:
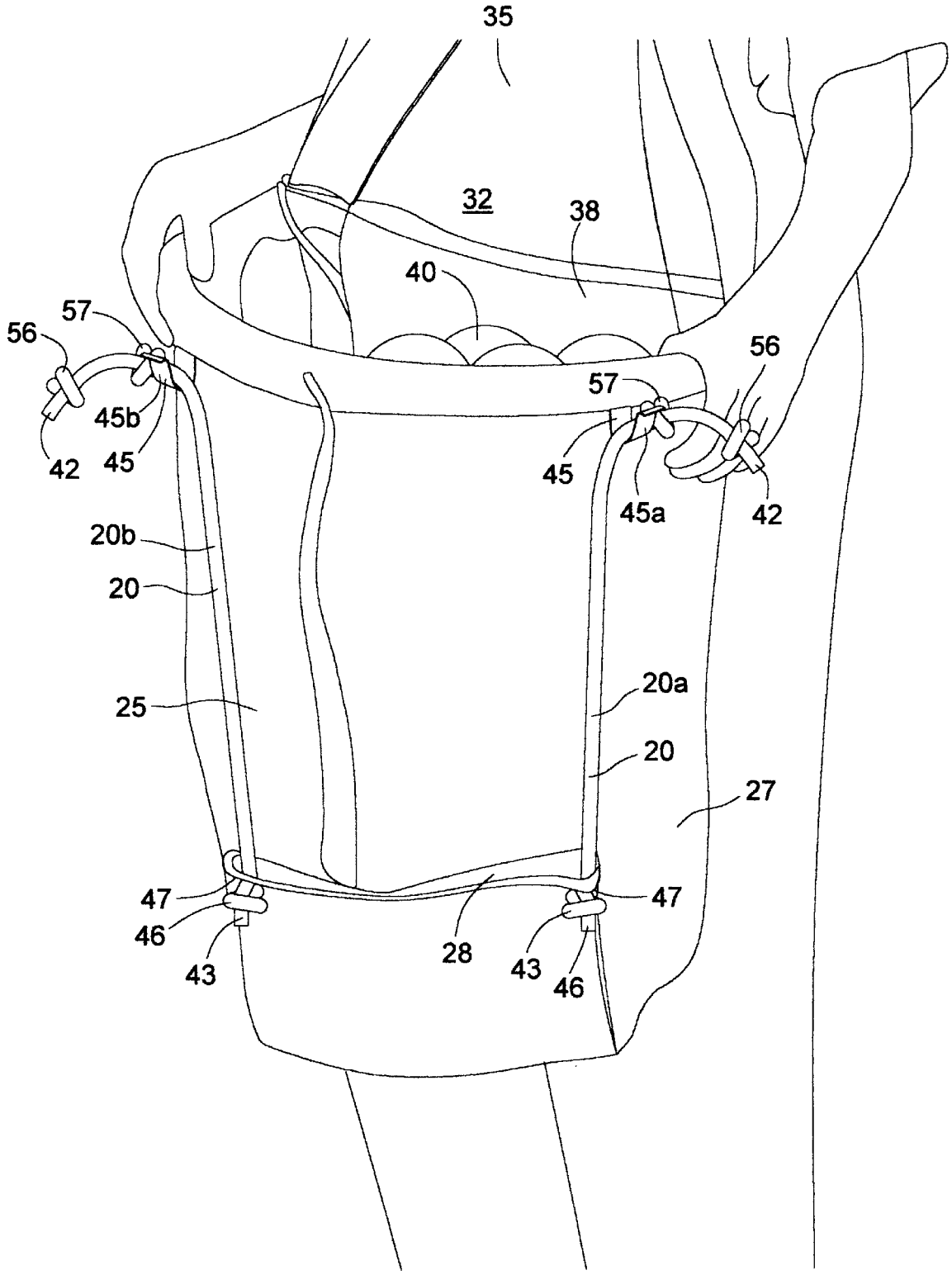
FIG. 2 is a perspective view of a support cord for a produce picking receptacle, as attached to the produce picking receptacle, according to an embodiment of the invention.
Figure 3:
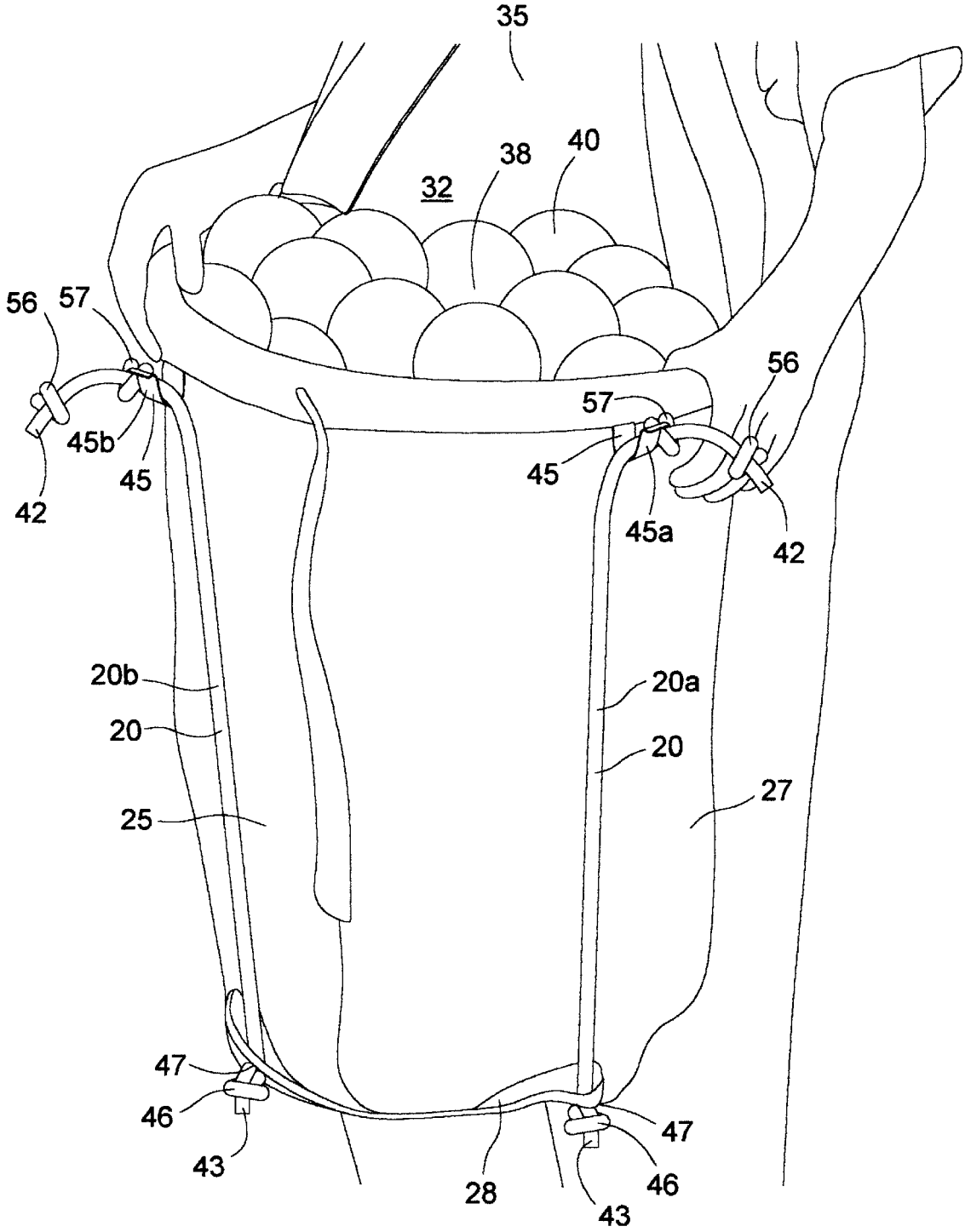
FIG. 3 is a perspective view of a support cord for a produce picking receptacle, as attached to the produce picking receptacle, according to an embodiment of the invention.
Figure 4:
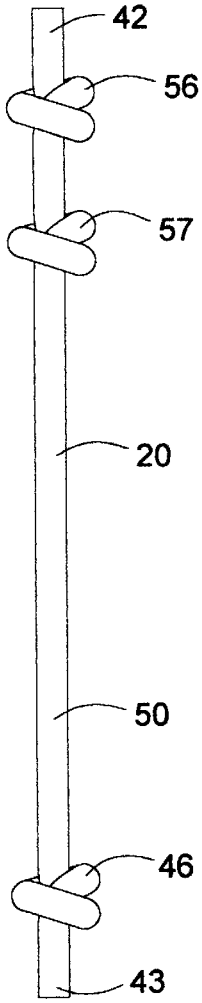
FIG. 4 is a side view of a support cord for a produce picking receptacle, in a relaxed position, according to an embodiment of the invention.

The tubular shape of the picking bag 25 is often modified to fit to the contour of a front 32 of a user 35 or picker. As discussed above, the tubular bag 27 is typically fabricated from a canvas material, often coated with a waterproofing material. The tubular bag has a top opening 38 that receives a produce product 40 or fruit, as shown in FIGS. 2 and 3. Typically, the fruit is placed individually into the picking bag by the picker.

The first support cord 20*a* and the second support cord 20*b* each include a top end 42 and a bottom end 43. The bottom end of the support cord is permanently attached to the tubular bag 27 of the picking bag at the bottom opening 28. A bottom knot 46 is included proximate to the bottom end of the support cord to attach it to the tubular bag. Preferably, the support cord threads through a bottom eyelet 47 and is then knotted with the bottom knot to prevent the support cord from releasing the bottom end of the tubular bag. For the present invention, other ways of securing the support cord proximate to the bottom opening of the tubular bag are considered as within the scope of the invention, such as thermal fusing, epoxy, stitching, clips or loops.

The top end 42 of each support cord 20 is removably attachable to the tubular bag 27 proximate to the top opening 38 of the picking bag 25 at a cord receiver 45. Two cord receivers are preferably used, as shown in FIGS. 1 through 3, with a first cord receiver 45*a* for retaining the first support cord and a second cord receiver 45*b* for retaining the second support cord. Conventionally, the cord receivers are hooked shaped brackets that extend from the produce picking receptacle proximate the top opening of the tubular bag, so that they can be reached easily by the user 35. The cord receivers are typically made from a metal or reenforced plastic and sized to grip the support cord 20 firmly.

The bottom opening 28, proximate the bottom end 43 of the tubular bag 27 is upwardly foldable to retain a quantity of the fruit 40 or produce product within the tubular bag. The folded bottom end is secured in place with the first support cord 20*a* held within the first cord receiver and the second support cord held within the second cord receiver. The tubular bag is upwardly "foldable," proximate to the bottom opening. This fold helps retain a quantity of the produce product 40 within the tubular bag.

The bottom opening 28 is downwardly unfoldable to slowly dump the produce product 40, or fruit, out of the tubular bag 27. This action is accomplished by removing the first support cord 20*a* from the first top cord receiver 45*a*, and removing the second support cord 20*b* from the second top cord receiver.

Conventionally, the ropes replaced by the support cords 20 of the present invention are made of an inelastic, non-stretchable material, such as a braided nylon. Also conventionally, the support rope can include an intermediate knot, as shown in U.S. Pat. No. 4,925,071 to Fleming et al., for the purpose of manually lengthening the tubular bag 27 to a single, preset intermediate length. All prior support cords, as typified by Fleming et al. '071, are formed from a non-stretchable material. All of the references reviewed fail to teach the use of a stretchable cord or strap to lengthen the bag's depth with the increase of fruit into the bag automatically. Instead, a required feature of these prior picking buckets and bags is that the support ropes do not stretch, and thereby prevent the bottom opening of the picking bag or bucket from unfolding and inadvertently dumping the fruit held within it; without the user first releasing the support ropes from the cord receivers 45.

The present invention provides an improvement in the inferior support ropes utilized with these conventional produce harvesting receptacles, as generically described above. The improved support cord 20 can be supplied with a new picking bag, as preferred, or the improved support cord of the present invention can simply replace the inelastic support ropes in the conventional fruit picking bucket or bag.

Specifically, the first support cord 20*a* and the second support cord 20*b* are permanently attached to the tubular bag 27 at the bottom opening 28 and removably attachable to the tubular bag proximate to the top opening 38, as shown in FIGS. 1 through 3, and discussed above. However, the improvement provided by the present invention is in the unique construction and functional properties of the improved support cord 20. The support cord extends to increase the holding capacity of the produce picking receptacle automatically, but only to the preset maximum capacity of the picking bag 25. This stretch allows the user 35 to continue picking without stopping to reposition the conventional support rope at longer length to increase the holding capacity of the picking bag, as is required with conventional picking bags. For the conventional picking bag, the user must first place the fruit down into the substantially empty bag to prevent the fruit from bruising. Therefore, an additional benefit of the stretchable support cords of the present invention is that the produce 40, which is typically a tree fruit, initially placed into the tubular bag does not drop to the deep bottom of a fully extended bag, but instead only to the bottom of the retracted bag, thereby minimizing the potential of bruising or other damage to the fruit.

The improved, limited stretch support cord 20 of the present invention allows the tubular bag 27 to extend with the weight of the fruit 40 as the fruit is placed into the picking bag, but only to a specifically limited extent. This limited stretch is accomplished by the unique construction of the support cords. The support cord has an outer sheath 50 housing an inner cord 52 within it. The outer sheath is preferably a rubber-like type of flexible tubular material. This outer sheath of flexible tubing stretches under increasing tension to approximately double its unstretched length. Most preferably, the outer sheath is a specially formulated thermoplastic elastomer (TPE), such as a thermoplastic rubber polymer tubing manufactured by Kent Elastomer Products, Inc. of Kent, Ohio, U.S.A., and specifically of the "K2000" series. TPE exhibits high flexibility, even in colder temperatures, excellent grip characteristics, resistance to sunlight, ozone, and maintains its original length, even after continuous, repeated stretching. A tubing with an outside diameter of approximately 0.25 inches (¼ inch or 0.635 cm) and a wall thickness of approximately 0.0625 inches (1/16th of an inch or 0.159 cm) is preferred for the outer sheath. The diameter and wall thickness can vary as needed for a specific selection of the outer sheath having desired stretching properties, such as the length of the stretch per force in stretching tension, as dictated by the physical features of the picking bag. Furthermore, the most preferred flexible tubing is opaque, to help minimize the damaging effects of sunlight. Natural latex ruber tubing is an alternative material for use in the outer sheath of the support cord, because this material also exhibits high flexibility, even in colder temperatures, excellent grip characteristics and a high memory, even after continuous, repeated stretching. Other tubing materials are also considered as potential alternatives. Stretchable formulations of poly vinyl chloride (PVC), and elastomeric blends have possibilities for use with the present invention. Any elastomeric material that meets the purposes of repeated, consistent stretching and required support of the picking bag in the orchard or field, can be employed as a possible alternative to the materials described above.

The inventor of the present invention found that the conventional rope supports found in common picking bags 25 are typically a stiffly braided nylon or similarly performing synthetic material. These conventional hard ropes often slipped out of the cord receivers 45. The support cords 20 of the present invention are pliable and supple. The elastic support cords stay well secured into the cord receivers and minimize inadvertent dumping of the produce picking receptacle. An additional benefit of the support cords of the present invention is that they can give slightly as the user 35 walks with the picking bag. This action provides additional protection against bruising when the picker moves from tree to tree or to the bin. Conventional, stiff and non-stretchable rope cords do not provide this compensative stretch to cushion and protect the harvested fruit within the bag.

Figure 5:
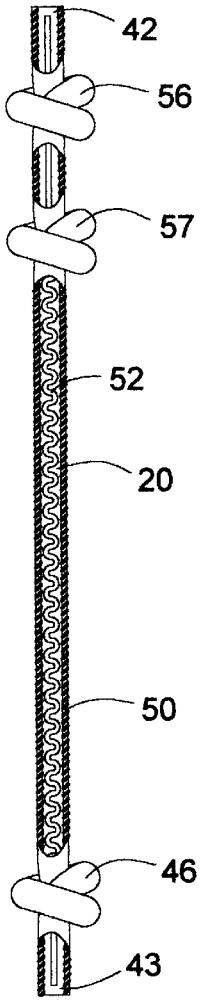
FIG. 5 is a partially sectioned side view perspective view of a support cord for a produce picking receptacle, in a relaxed position, according to an embodiment of the invention.
Figure 7:
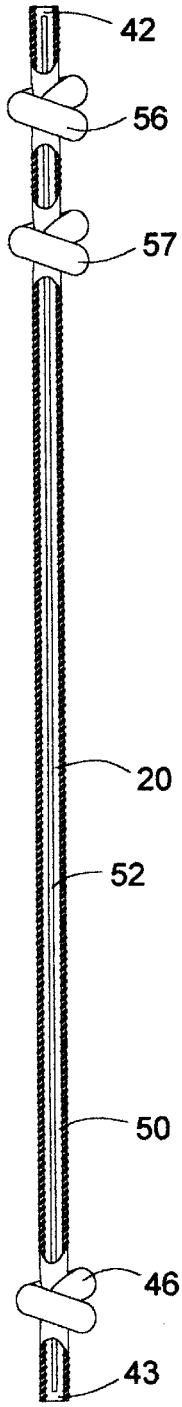
FIG. 7 is a partially sectioned side view of a support cord for a produce picking receptacle, in an extended position, according to an embodiment of the invention.

Within the outer sheath 50, an inner cord 52 is included in the support cord 20, of the present invention, as shown in FIGS. 5 and 7, and detailed in FIGS. 8 through 11. The non-stretchable inner cord limits the stretching of the outer sheath to a specific and preset length. This limited stretch prevents fruit from spilling out of the bottom of the bag, and also prevents over-stretching or breaking of the outer sheath.

The inner cord 52 is preferably made from a twisted fiber cord. Most preferably this cord is a "poly" or plastic twine of approximately 1/16 inch (0.159 cm) in diameter, such as the preferred, twisted polypropylene "Poly-Manyends™" brand of twine made by Winmore Manufacturing, of Korea. There are several potential alternatives to polypropylene twine, such as polyester or nylon. The most preferred twine has at least a 60 pound (27.2 kg) breaking strength, does not absorb moisture, is resistant to abrasion and mold, and does not stretch appreciably under the normal weight loads encountered within the support cord 20. The twine must remain supple and should have a long life without becoming brittle, especially under outdoor temperature extremes. Any natural or synthetic twine or yam that meet these criteria could be employed as an alternative to the preferred poly twine.

Figure 8:
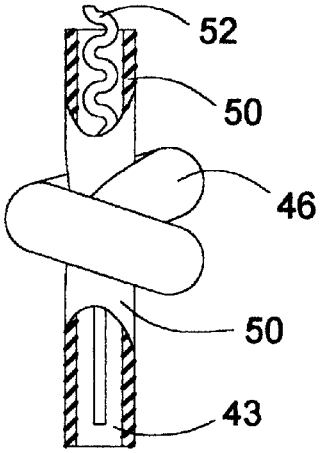
FIG. 8 is a partially sectioned side view of a bottom portion of a support cord, according to an embodiment of the invention.
Figure 9:
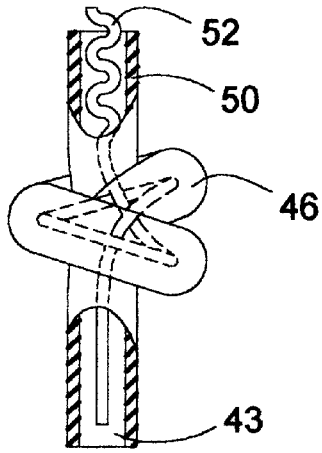
FIG. 9 is a partially sectioned and partially hidden lined side view of a bottom portion of a support cord, according to an embodiment of the invention.

Both ends of the limited stretch support cord 20 are knotted to lock the inner or "stop" chord 52 within the outer sheath 50. As discussed above, the bottom end 43 of each support cord includes a bottom knot 46 that prevents the support cord from pulling through the bottom eyelet 57 of the tubular bag 27. The bottom knot is shown in FIGS. 8 and 9. As specifically detailed in FIG. 9, the inner cord threads through the knot and so the inner cord is locked in place within the support cord. The top end of the support cord preferably includes two knots. As shown in FIGS. 1 through 7, 10 and 11, the support cord includes a grip knot 56, near the top end of the support cord and a stop knot 57, placed further toward the bottom end 43 of the support cord. The distance between the grip knot and the stop knot is preferably approximately 1.5 to 2 inches (3.8 to 5.1 cm). This distance provides the user 35 with a handle, or grip, for grasping the support cord and removing the support cord at the stop knot from the cord receiver 45, when required.

Figure 10:
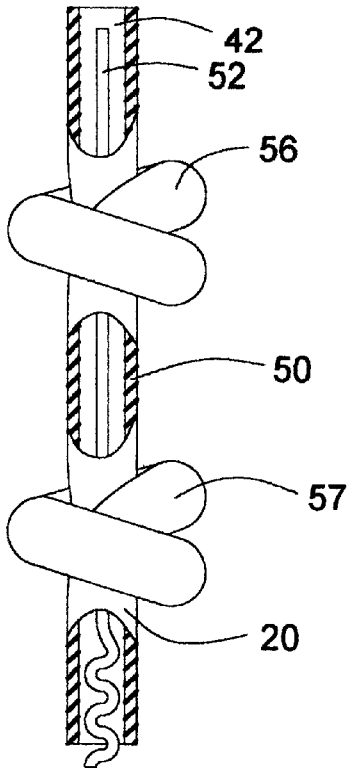
FIG. 10 is a partially sectioned side view of a top portion of a support cord, according to an embodiment of the invention.
Figure 11:
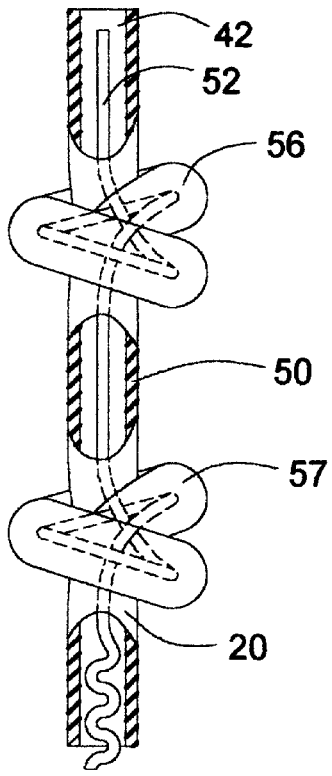
FIG. 11 is a partially sectioned and partially hidden lined side view of a top portion of a support cord, according to an embodiment of the invention.

The pair of knots proximate to the top end 42 of the support cord 20 are shown in FIGS. 10 and 11. As detailed in FIG. 11, the grip knot 56 and the stop knot 57 both preferably include the inner cord 52 threaded through them. This prevents the inner cord from being drawn into the support cord as the support cord is stretched.

Specifically, the first support cord and the second support cord stretch to extend the length of the tubular bag in response to the weight of the produce product received into the produce picking receptacle. The support cords have a "relaxed," or unstretched length of approximately 12 to 14 inches (30.5 to 35.5 cm). The support cords each have a "limited" or partial stretch that extends approximately 6 to 8 inches (15 to 20 cm), for a total limited stretch length of approximately 18 to 22 inches (45.7 to 55.9 cm). This limited stretch extension prevents the produce product from escaping out of the bottom opening of the tubular bag when the first support cord is received within the first top cord receiver and the second support cord is received within the second top cord receiver.

The support cords 20 are at their relaxed length when little or no fruit 40 is present within the picking bag 25 or receptacle, as shown in FIG. 1. The bottom end 43 of the tubular bag 27 is well folded to shorten the length of the tubular bag and reduce the volume of the picking bag. The shortened bag minimizes the distance that fruit drops into the picking bag and so reduces bruising injury to the fruit. When relaxed, the inner cord naturally coils within the support cord, as shown in FIG. 5. This coiling occurs because the inner cord is, as preferred, originally stored on a spool before the assembly of the support cord. The inner cord is held within the outer sheath by the knots in the cord, as discussed above.

As more fruit 40 is placed into the produce picking receptacle 25, the support cord 20 gradually lengthens, as shown in FIG. 2. The outer sheath 50 stretches as the support cord extends from the relaxed length to the limited and partially stretched length, and the inner cord 52 within the hollow core of the outer sheath begins to uncoil. The volume and so the fruit caring capacity of the fruit picking receptacle begins to expand as the bottom end of the tubular bag 27 begins to unfold slowly.

Figure 6:
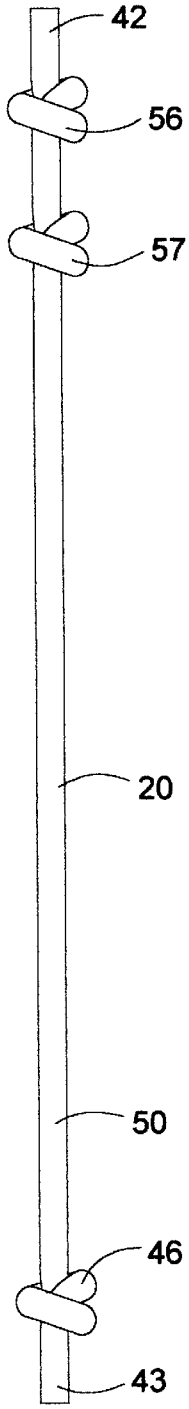
FIG. 6 is a side view of a support cord for a produce picking receptacle, in an extend ed position, according to an embodiment of the invention.

As shown in FIG. 3, the produce picking receptacle 25 can continue to expand as more fruit 40 is placed within, up until the support cords 20 reach their limited stretch length. The fixed length of the inner cord 52 constrains the stretching of the outer sheath and so prevents the tubular bag from unfolding any further. This limited stretch also prevents the fruit from dumping out of the bottom end 43 of the bag, until the user 35 releases both of the stop knots 57, on the first support cord 20*a* and the second support cord 20*b*, from the respective cord receivers 45. FIGS. 6 and 7 show the support cord in the stop stretch position. As detailed in FIG. 7, the inner cord is taut and tightly held within the outer sheath, and so prevents the support cord from stretching any further.

To manufacture the support cord 20 of the present invention, the outer sheath 50 and the inner cord 52 are first cut to the desired lengths. Specifically, the outer sheath is cut to the length that will properly support the tubular bag of the picking bag as shown in FIG. 1 and accommodate the three knots, as needed. The inner cord is cut to a length exactly sufficient to support the tubular bag 27 of the picking bag at the filly extended length as shown in FIG. 3. The inventor has found that the inner cord can be cut to approximately 32 inches (81.3 cm) for a preferred embodiment of the support cord. After the inner cord is "fished" or threaded through the outer sheath,, the bottom knot 46 is tied near the bottom end of the support cord. A simple overhand knot is sufficient. The inner cord is preferably threaded through the outer sheath with the aid of a pulse of compressed air. Most preferably, this is accomplished with a "socket" or slotted cap inserted into the end of the outer sheath to feed in the inner cord. As an alternative, a shuttle, or a length of wire or wood could also be used to thread the inner cord through the outer sheath.

Preferably, the bottom knot 46 is then held in place while the top end 42 of the support cord 20 is pulled from a point that roughly coincides with the location of the stop knot. The stop knot 57 can be located by measuring the distance between the bottom eyelet 47 and the cord retainer 45, when the produce picking receptacle 25 is in the empty and folded position, as depicted in FIG. 1. The stop knot is preferably separated from the bottom knot by this measured distance.

The support cord 20 is then pulled until the fully extended length is reached. This length is easily calculated by measuring the separation of the bottom eyelet 47 and the cord retainer 45, when the produce picking receptacle 25 is in the "full-to-capacity" position, as depicted in FIG. 3. The inner cord 52 is tightened and the stop knot 57 tied, to set the length of the inner cord within the outer sheath 50 permanently. The grip knot 56 can now be tied near the top end 42 of the support cord. With the bottom knot tied, the support cord can be threaded through the bottom eyelet of the picking bag and then tied to secure it to the bag.

The grip knot 56 and the stop knot 57 are much softer than the rope knots typically employed in picking bags 25. This prevents damage to the fruit 40 when the picking bag is dumped. The support cords 20 are often impacted by the fruit as it exits the bag. As an additional alternative, the two support cords could be replaced by a single support cord that is connected together at the top ends 42, but otherwise having the same limited stretch features as disclosed above.

In EXAMPLE 1, as follows, a simple comparative test illustrates a potential savings and benefits from picking bags fitted with the improved support cords 20 of the present invention.

EXAMPLE 1

A conventional apple picking bag, as manufactured by Wells & Wade™ of Wenatchee WA, U.S.A. and designated as model number "80SL," is issued to a skilled picker. The picker is directed to pick within a block of golden delicious apples. The non-stretchable support ropes of this conventional bag have an added, intermediate knot that must be adjusted as the picking bag fills with fruit. This prevents bruising of the fruit as the apples are first placed into the picking bag. The operation of lengthening the support ropes requires approximately 15 seconds to one half of a minute each time it is performed. The picker is able to harvest 8 bins of apples in an eight hour period, each bin containing approximately 1,000 pounds (453.6 kg) of apples. Since the picker's bag holds approximately 46 pounds (20.87 kg) of apples, this equates to 21.7 bags of apples picked per hour, by the picker.

The next day, the same picker is issued the same picking bag, but retrofitted with the improved, limited stretch support cords of the present invention. The same block of apples is further harvested by the picker. After eight hours, the picker harvested 8.5 bins of apples. This equates to 23.1 bags of apples picked per hour.

This example clearly illustrates that the benefits of the present invention translate into substantial savings for the grower and additionally the picker, who is often paid by the bin.

In compliance with the statutes, the invention has been described in language more or less specific as to structural features and process steps. While this invention is susceptible to embodiment in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

What is claimed is:

1. A produce picking receptacle having improved support cords, the produce picking receptacle of the type having;

a substantially tubular receptacle with a top opening and a bottom opening, a first support cord permanently attached to the tubular receptacle at the bottom opening, and the first support cord removably attachable to the tubular receptacle proximate to the top opening at a first top cord receiver, a second support cord permanently attached to the tubular receptacle at the bottom opening and the second support cord removably attachable to the tubular receptacle proximate to the top opening at a second top cord receiver, the tubular receptacle upwardly foldable proximate to the bottom opening, to retain a quantity of a produce product within the tubular receptacle, with the first support cord received into the first cord receiver and the second support cord received into the second cord receiver, and the bottom opening downwardly unfoldable to dump the produce product from the bottom opening of the tubular receptacle, with the first support cord removed from the first cord receiver and the second support cord removed from the second cord receiver, wherein the improvement comprises:

the first support cord and the second support cord stretch to extend the length of the tubular receptacle in response to the quantity of the produce product received into the produce picking receptacle.

2. The produce picking receptacle of claim 1, wherein:

the first support cord is received within the first top cord receiver and the second support cord is received within the second top cord receiver;

the first support cord and the second support cord have a relaxed length, and the first support cord and the second support cord have a limited stretch length of approximately twice the relaxed length; and the limited stretch length is selected to prevent the produce product from escaping out of the bottom opening of the tubular receptacle when the length of the tubular receptacle extends.

3. The produce picking receptacle of claim 1, wherein the first support cord and the second support cord each include:

an outer sheath, the outer sheath substantially elastic and tubular, the outer sheath stretchable from a relaxed length to a partially stretched length, and the outer sheath having a top end and a bottom end;

an inner cord, the inner cord having a fixed length, the inner cord substantially inelastic, the outer sheath having a hollow core, the inner cord receivable within the hollow core of the outer sheath, the fixed length of the inner cord approximately equal to the partially stretched length of the outer sheath, the inner cord attached proximate to the top end of the outer sheath, and the inner cord attached to the bottom end of the outer sheath; and a first end of the limited stretch cord attachable proximate the bottom of the receptacle, and a second end of the limited stretch cord attachable proximate the top of the receptacle; and the limited stretch cord for extending the length of the receptacle as a quantity of fruit is placed into the receptacle.

4. A supportive cord for a produce picking receptacle, the produce picking receptacle having a bottom and a top, the supportive cord comprising:

an outer sheath, the outer sheath being substantially elastic, the outer sheath having a hollow tubular core, the outer sheath stretchable from a relaxed length to a stretched length, and the outer sheath having a top end and a bottom end;

an inner cord, the inner cord having a fixed length, the inner cord being substantially inelastic, and the inner cord receivable within the hollow tubular core of the outer sheath, and the fixed length of the inner cord approximately equal to the stretched length of the outer sheath;

the supportive cord having a first end and a second end, the first end of the supportive cord attachable proximate to the bottom of the produce picking receptacle, the second end of the supportive cord removably attachable proximate to the top of the produce picking receptacle, and the supportive cord stretches to extend the length of the produce picking receptacle as a quantity of fruit is placed into the produce picking receptacle;

the supportive cord including a top knot in the outer sheath, proximate the top end of the outer sheath, the supportive cord including a bottom knot in the outer sheath, proximate to the bottom end of the outer sheath; and the inner cord threaded through the top knot in the outer sheath, and the inner cord threaded through the bottom knot in the outer sheath.

5. The supportive cord for a produce picking receptacle of claim 4 wherein the stretched length of the outer sheath is limited to the fixed length of the inner cord.

* * * * *